US006447352B1

(12) United States Patent
Nuss

(10) Patent No.: US 6,447,352 B1
(45) Date of Patent: Sep. 10, 2002

(54) PROPULSION SYSTEM

(75) Inventor: W. Philip Nuss, Covington, LA (US)

(73) Assignee: Halter Marine, Inc., Gulfport, MS (US)

( * ) Notice: Subject to any disclaimer, the term of this patent is extended or adjusted under 35 U.S.C. 154(b) by 0 days.

(21) Appl. No.: 09/714,397

(22) Filed: Nov. 16, 2000

(51) Int. Cl.[7] ..... B63H 1/04
(52) U.S. Cl. ..... 440/90
(58) Field of Search ..... 440/90–92, 5, 440/6, 111

(56) References Cited

U.S. PATENT DOCUMENTS 2,057,990 A * 10/1936 Whitaker ..... 248/650
3,170,437 A * 2/1965 Kilmer ..... 440/5
3,954,084 A 5/1976 Cronin
5,158,150 A * 10/1992 Askeland et al. ..... 180/305
5,501,072 A 3/1996 Plancich et al.
5,505,640 A 4/1996 Angulo
5,632,661 A 5/1997 Jurgens et al.
5,850,801 A 12/1998 Grimmig

* cited by examiner

*Primary Examiner*—Ed Swinehart
(74) *Attorney, Agent, or Firm*—Len R. Brignac

(57) ABSTRACT

A paddle drive system comprising:

a slow speed hydraulic motor drive having at least one bearing which is axial, radial or both axial and radial; and a shaft secured to the at least one bearing of the hydraulic motor; and at least one, and preferably two paddlewheels, secured to said shaft, each paddlewheel comprising:

a plurality of diaphragm plates, each diaphragm plate secured on one end to said shaft;

a plurality of radial arms, each arm having a first end and a second end, said radial arms secured to said diaphragm plate on said first end; and at least one bucket secured to said second end of said plurality of radial arms.

1 Claim, 4 Drawing Sheets

PROPULSION SYSTEM

BACKGROUND OF THE INVENTION

The invention refers to a hydraulic propulsion system capable of rotating a series of paddles or buckets to generate thrust. The invention is most ideally suited to the propulsion system of a shallow-draft vessel, such as a riverboat on the Mississippi.

The present system has been developed for use by self-propelled vessels in extremely low water situations, such as canals or for use by river boats on the Mississippi river which need to avoid debris submerged under water which can damage a conventional propeller. Because the vessel operates in fresh water and the entire propulsion system is above the waterline, maritime repair is possible without dry-docking. The propulsion system, which in the most preferred embodiment, is a paddlewheel drive system, is particularly useful for vessels in waterways with submerged tree logs or other flood water debris.

SUMMARY OF THE INVENTION

It is an object of the present invention to provide an improved propulsion device, particularly for maritime vessels to simplify and reduce the risk of shaft breakage during operation of a paddlewheel. The invention involves connecting the shaft directly to the motor flange radial bearings for the paddlewheel system. Additionally, a novel method for supporting the paddlewheel for alignment and a related pedestal are described which enables a shaft to be easily aligned, should a shaft or motor need replacing.

BRIEF DESCRIPTION OF THE DRAWINGS

The device contemplated by the invention is illustrated in the accompanying drawings, wherein.

DETAILED DESCRIPTION

The present invention can be used on various ships and other watercraft and vessels for example, a riverboat, a barge, a cargo ship, or a grain carrier.

Figure 1:
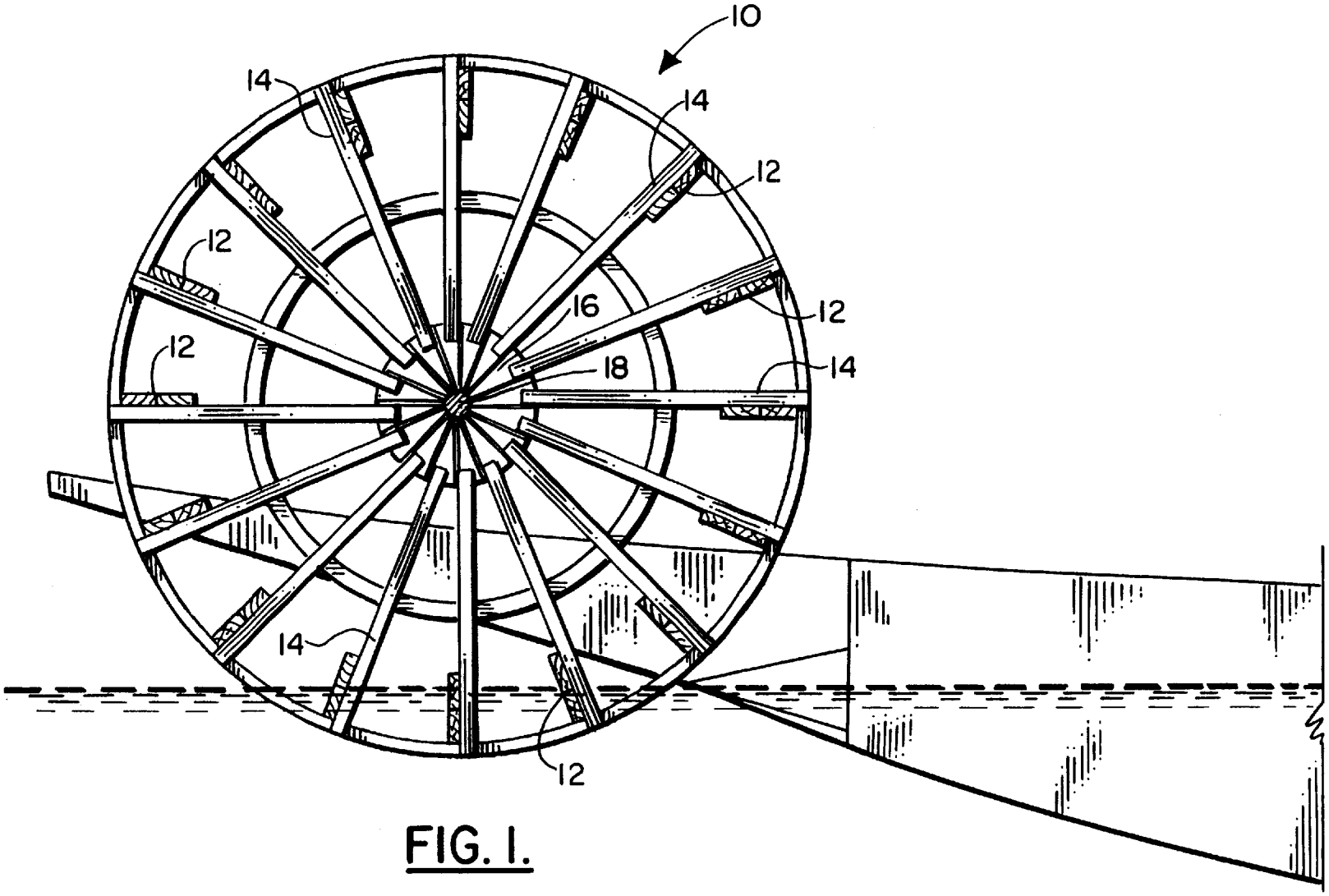
FIG. 1 is a side view of a paddlewheel.

In the preferred embodiment, it is contemplated that two paddlewheels are attached to a shaft to propel a watercraft. One paddlewheel 10 is shown in FIG. 1. Sixteen buckets 12 are secured to each wheel. Each bucket 12 is attached to a radial arm 14 on a first end. On the second end of the radial arm 14, the arm is secured to a diaphragm plate 16. The diaphragm plate 16 is secured to a shaft 18 which is attached to a hydraulic motor.

Figure 2:
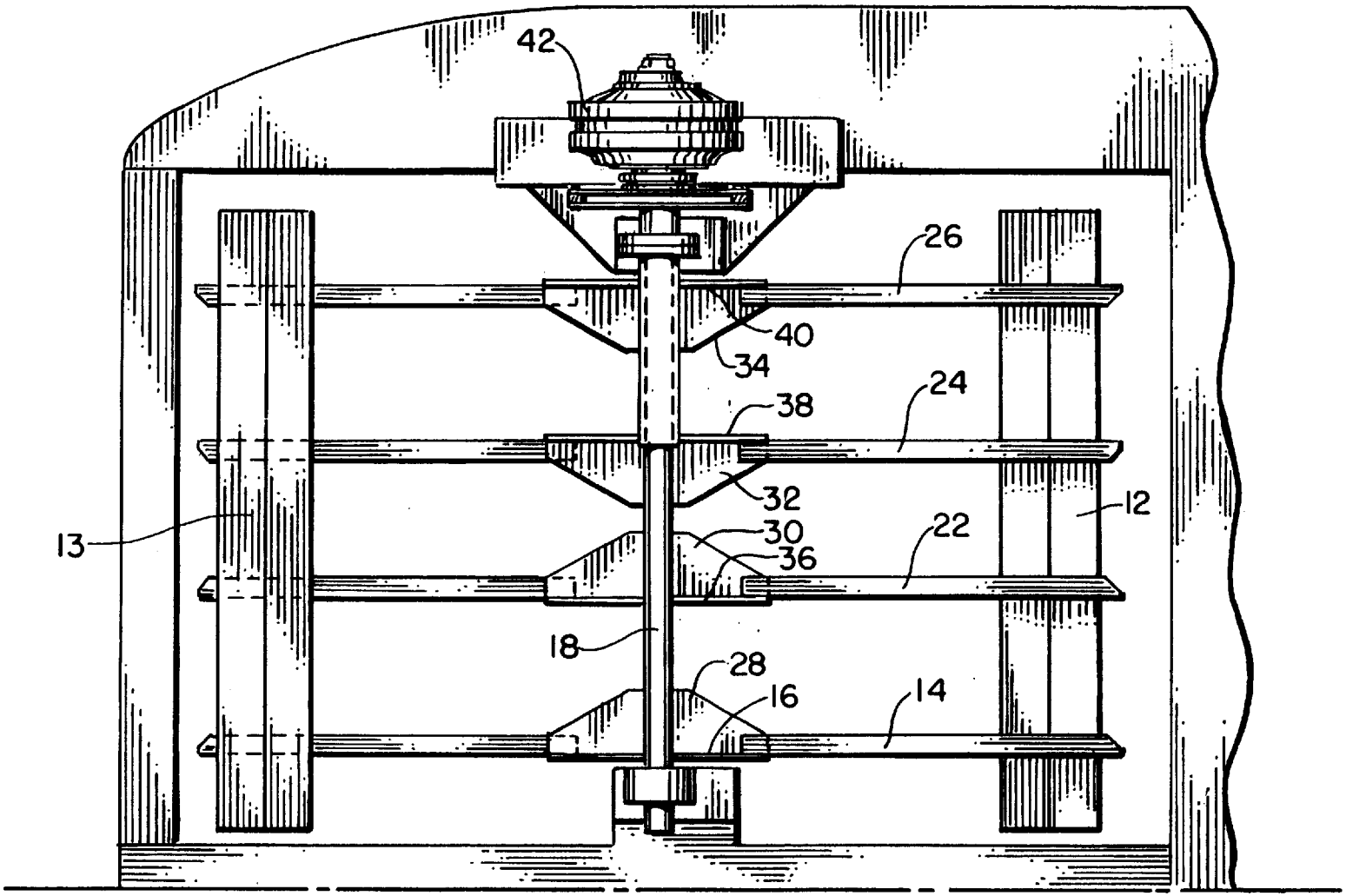
FIG. 2 is a cross sectional view of the paddle drive system.

FIG. 2 shows the buckets 12 and 13 secured to the radial arms 14, 22, 24 and 26 using brackets 28, 30, 32 and 34. Each bracket is preferably triangular in shape.

The radial arms 14, 22, 24 and 26 are also secured to the shaft 18 using diaphragm plates 16, 36, 38 and 40. Each radial arm has the shape of from 20 to 30 inches in length, and 12 to 18 inches in width and approximately ⅗ to ½ inches in depth. The arms are preferably made of steel, but they can be made of composite or laminated wood. The number of arms, the shape of the arms, the thickness of the arms, the location of the paddlewheel on the watercraft, and the materials used can vary dependant upon the particular vessel and its demands.

FIG. 2 also shows the shaft 18 secured to the hydraulic motor 42. The shaft 18 is directly secured to the inboard bearing for the hydraulic motor 42. The inboard bearing, hereinafter called "bearing," is radial or axial or both.

Figure 3:
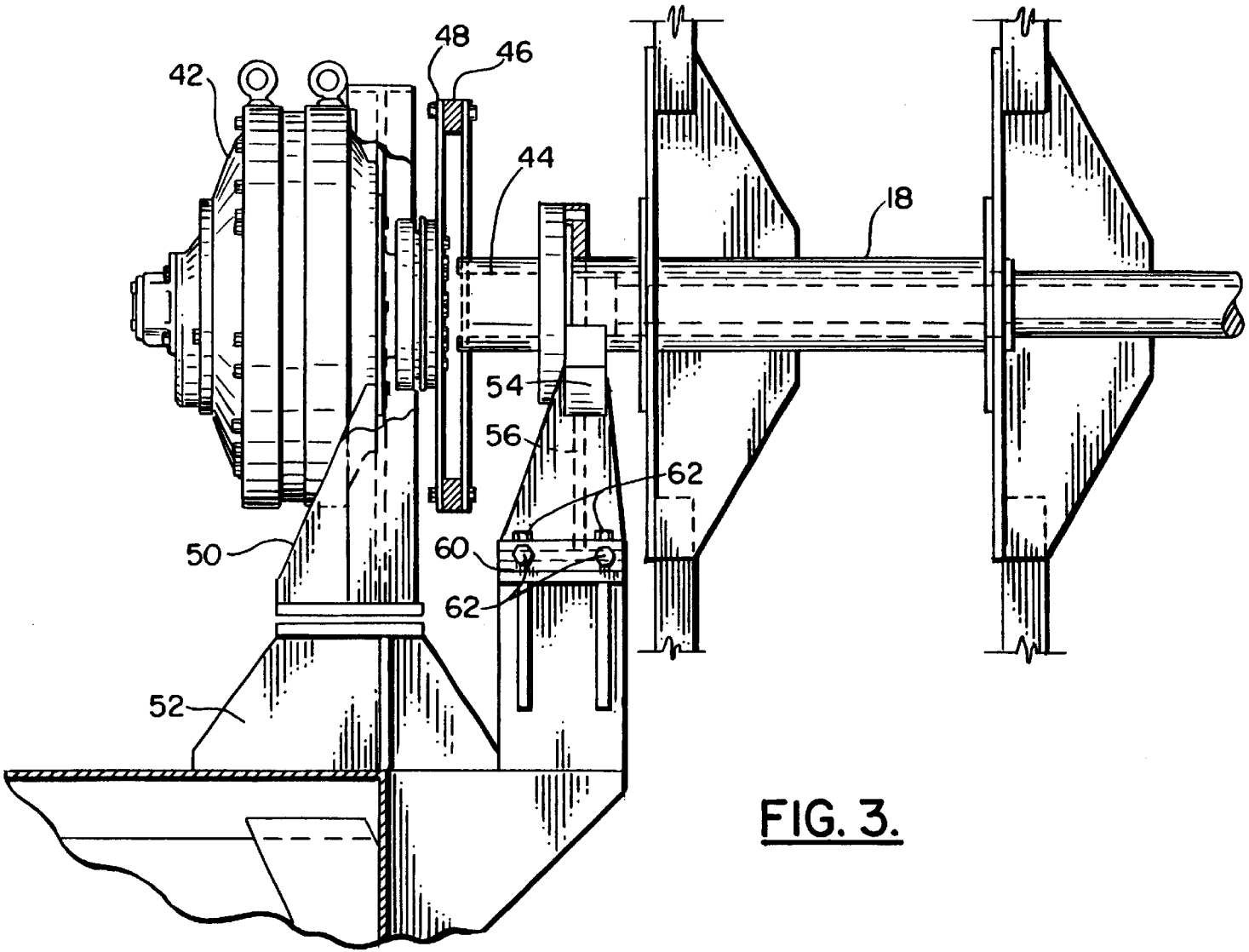
FIG. 3 is a detailed view of the shaft secured to the hydraulic motor.

FIG. 3 shows a detail of the shaft 18 secured to the hydraulic motor 42. Additionally, FIG. 3 shows the placement of the shaft alignment pedestal adjacent the shaft and secured to the spool piece 44. Spool piece 44 is secured to ring spacer 46 and plate flange 48 providing a clearance between the plate flange 48 and ringer spacer 46 of between 1 and 2 inches, most preferably 1.25 inches.

Motor bracket 50 holds motor 42 in place. Motor bracket 50 is secured to motor foundation 52.

Figure 4:
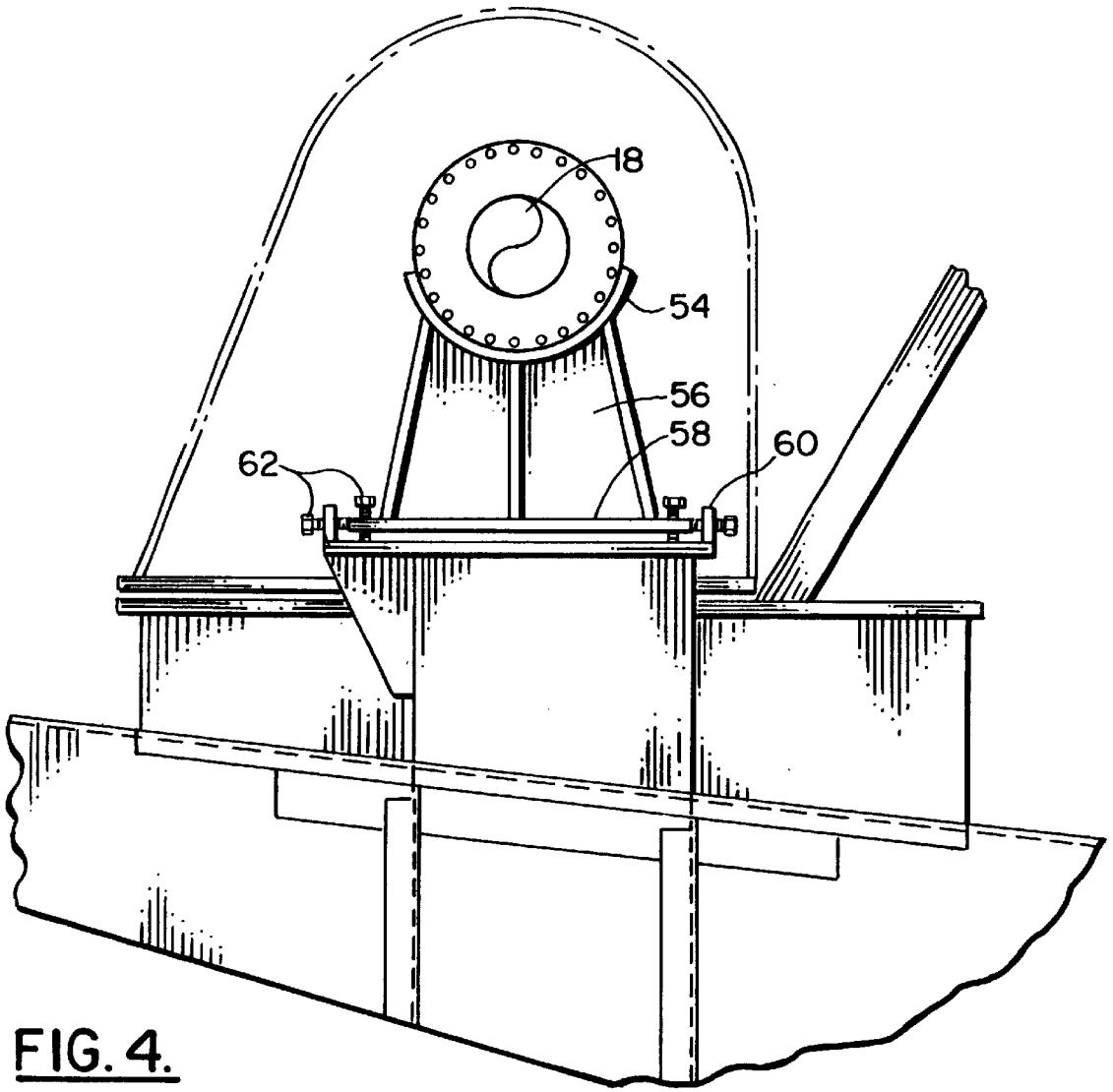
FIG. 4 is a detail view of the shaft alignment pedestal.

FIG. 4 shows shaft alignment pedestal having a flange rest 54, stiffener 56, foundation plate 58, end piece 60 and various jacking bolts 62. Preferably, up to 8 jacking bolts are utilized within the scope of this invention.

The shaft tool pedestal supports the paddlewheel, and makes it less tedious to align a shaft with the motor by letting the steel of the shaft deflect and permitting the steel's elastic limit to allow stress into the system, as it would operate.

The paddle drive system is not limited to a certain number of radial arms or a certain range of horsepower. The propulsion system can be adjusted to be more powerful or with fewer arms and buckets depending on the size of the vessel or the amount of water which needs to be moved.

The propulsion system is preferably hydraulic, but an electric system is also contemplated by this invention, and is especially useful for a propulsion system on a vessel, which does not require dry docketing.

The invention as described herein above in the context of the preferred embodiments is not to be taken as limited to all of the provided details thereof, since modifications and variations thereof may be made without departing form the spirit and scope of the invention.

What is claimed is:

1. A paddle drive system comprising:

a slow speed hydraulic motor drive having at least one bearing; and a shaft secured to said at least one bearing; and at least one paddle wheel secured to said shaft, comprising:

a plurality of diaphragm plates secured to said shaft;

a plurality of radial arms, each arm having a first end and a second end, said radial arm secured to said diaphragm plate on said first end; and at least one bucket secured to said second end of said plurality of radial arms, wherein said radial arms are additionally secured to said diaphragm plate with at least one bracket per arm, wherein said hydraulic motor is mounted on a motor bracket and foundation, wherein a shaft alignment pedestal is secured adjacent to said shaft, and wherein said shaft alignment pedestal comprises: a first end secured to a flange rest, a stiffener, a foundation plate, a plurality of jacking bolts, an end plate and gussets connected to the foundation.

* * * * *